US007371985B2

(12) United States Patent
Chen

(10) Patent No.: US 7,371,985 B2
(45) Date of Patent: May 13, 2008

(54) WATERTIGHT KEY SWITCH ASSEMBLY AND ITS FABRICATION

(75) Inventor: Maw Rong Chen, Shin Chung (TW)

(73) Assignee: Chen Han Precision Mould Co., Ltd., Taipei County (TW)

( * ) Notice: Subject to any disclaimer, the term of this patent is extended or adjusted under 35 U.S.C. 154(b) by 0 days.

(21) Appl. No.: 11/643,859

(22) Filed: Dec. 22, 2006

(65) Prior Publication Data

US 2007/0144873 A1 Jun. 28, 2007

(30) Foreign Application Priority Data

Dec. 26, 2005 (TW) ..... 94146460 A

(51) Int. Cl.
*H01H 13/02* (2006.01)

(52) U.S. Cl. ..... 200/302.1; 200/302.2

(58) Field of Classification Search ..... 200/511, 200/512, 341, 345, 302.1, 302.2; 341/20, 341/22; 345/156, 168, 169
See application file for complete search history.

(56) References Cited

U.S. PATENT DOCUMENTS 4,194,097 A * 3/1980 Bradam ..... 200/5 A
5,616,897 A * 4/1997 Weber et al. ..... 200/5 A
5,666,112 A * 9/1997 Crowley et al. ..... 341/22
6,288,353 B1 * 9/2001 Chiang ..... 200/512
6,585,435 B2 * 7/2003 Fang ..... 400/479
6,639,162 B2 * 10/2003 Sandbach et al. ..... 200/512
6,700,086 B2 * 3/2004 Serizawa et al. ..... 200/512
6,756,555 B2 * 6/2004 Lin ..... 200/512
6,861,961 B2 * 3/2005 Sandbach et al. ..... 341/22
7,091,436 B2 * 8/2006 Serban ..... 200/512

* cited by examiner

*Primary Examiner*—Michael A Friedhofer
(74) *Attorney, Agent, or Firm*—Troxell Law Office, PLLC

(57) ABSTRACT

A bendable, washable, watertight key switch assembly is disclosed to include a polymeric flexible top layer made, which has key caps and a conducting member respectively bonded to the inside wall of each key cap, a polymeric flexible bottom layer defining with the flexible top layer an accommodation space, and a thin film circuit board set in the accommodation space and sealed to the flexible top layer and the flexible bottom layer with an adhesive, the thin film circuit board having printed switch contacts corresponding to the conducting members in the key caps for the contact of the associating conducting members to output a corresponding electric signal and a cable electrically connected to the printed switch contacts and extended out of the flexible top layer and the flexible bottom layer at one side for connection to an external electronic device.

13 Claims, 4 Drawing Sheets

WATERTIGHT KEY SWITCH ASSEMBLY AND ITS FABRICATION

BACKGROUND OF THE INVENTION

1. Field of the Invention

The present invention relates generally to key switch assemblies and more particularly, to a watertight key switch assembly, which is bendable and washable with water, and superior in weather-resisting property. The invention relates also to the fabrication of such a watertight key switch assembly.

2. Description of the Related Art

A mobile digital data playing apparatus, for example, mobile CD/VCD/DVD player or MP3 player has been intensively used by many people as one's mobile personal music-playing device. These digital data playing apparatus are high-precision electronic products. When a digital data playing apparatus is exposed to a high or low temperature environment for a long period of time, the internal electronic component parts may become abnormal, failing to function well. Further, these electronic products are commonly equipped with key switches for operation. However, regular key switches are inferior in waterproof property. When wetted, the electronic components on the inside circuit board may be damaged, resulting in malfunctioning of the product.

There are manufacturers who provide waterproof key switches. Taiwan Patent Publication No. M269556, issued on Jul. 1$^{st}$, 2005, entitled "Waterproof key switch", shows an example. According to this design, the waterproof key switch comprises a hard key cap, a flexible key switch holder, a hard bottom plate having a plurality of switches, and a hard shell covering the hard bottom plate. The key cap has a plunger downwardly extended from the bottom side thereof and inserted through a through hole on the key switch holder. This design of key switch has a waterproof characteristic. However, when the key switch is dipped in water, water will go through the through hole on the key switch holder to wet the switches, loosing its waterproof capability.

Further, U.S. Pat. No. 5,087,606 discloses a waterproof key switch design entitled "Waterproof switch with single contact and method for manufacturing same". According to this design, the waterproof switch has a single contact arranged in a sealed housing, with an actuator arm protruding from one end and electrical terminals protruding from an opposite end. The single contact is arranged close to a metal portion that is moved by the actuator into mechanical and electrical contact with the single contact. The sealed housing is formed of two pieces that are attached by a heat activated adhesive. The switch can be assembled by forming the metal switch parts on a long strip and subsequently, following the assembly of the housing, the small metal portions joining the switch parts are sheared away. This design of switch assembly is function and waterproof. However, the hard material property of the housing does not allow bending of the switch assembly, limiting the applicability of the switch assembly. Further, when the switch assembly is mechanically washed with water, the internal parts may be forced out of place, loosing the waterproof capability of the switch assembly.

Therefore, it is desirable to provide a watertight key switch assembly that eliminates the aforesaid drawbacks.

SUMMARY OF THE INVENTION

The present invention has been accomplished under the circumstances in view. It is therefore the main object of the present invention to provide a watertight key switch structure, which is bendable and washable with water, and superior in weather-resisting property.

According to one aspect of the present invention, the watertight key switch assembly comprises a flexible top layer, a flexible bottom layer, and a thin film circuit board. The flexible top layer is made out of a polymeric material, having at least one key cap and a conducting member respectively fixedly mounted on an inside wall of each key cap. The flexible bottom layer is made out of a polymeric material and fastened to the flexible top layer, defining with the flexible top layer an accommodation space. The thin film circuit board is set in the accommodation space between the flexible top layer and the flexible bottom layer and sealed to the flexible top layer and the flexible bottom layer with an adhesive. The thin film circuit board has at least one printed switch contact means corresponding to the conducting member in each key cap for the contact of the associating conducting member to output a corresponding electric signal, and a cable electrically connected to the at least one printed switch contact means and extended out of one side of the flexible top layer and the corresponding side of the flexible bottom layer for connection to an external electronic device.

According to another aspect of the present invention, the polymeric material for the flexible top layer and the flexible bottom layer can be silicon rubber or rubber. Further, the flexible top layer has an upwardly protruding platform; the at least one conducting member each is a conducting carbon bead; the at least one key cap is respectively formed integral with the upwardly protruding platform. Further, the thin film circuit board has a bottom surface bonded with a reinforcing sheet member.

According to still another aspect of the present invention, a positioning structure is provided between the flexible top layer and the flexible bottom layer. The positioning structure comprises a recess formed on one of the flexible top and bottom layers and adapted to accommodate the thin film circuit board, a plurality of mounting through holes formed on the thin film circuit board, a plurality of pinholes formed the other one of the flexible top and bottom layers corresponding to the mounting through holes, and a plurality of pins formed on one of the flexible top and bottom layers without the pinholes and respectively inserted through the mounting through holes and fitted into the pinholes.

According to still another aspect of the present invention, the accommodation space comprises a recess formed on one of the flexible top and bottom layers for accommodating the thin film circuit board, and a cable slot formed on the other one of the flexible top and bottom layers without the recess for the passing of the cable.

According to still another aspect of the present invention, the watertight key switch assembly fabrication procedure comprises the steps of (a) putting two polymeric sheet materials in the cavity of a mold, and then placing at least one conducting member on one polymeric sheet material at each selected location key cap, and then closing the mold and heating the mold and drawing air out of the mold into a vacuum state to have the polymeric sheet materials be respectively molded into a flexible top layer and a flexible bottom layer where an accommodation space is defined between the flexible top layer and the flexible bottom layer and the at least one conducting member is fixedly fastened to one of the flexible top layer and the flexible bottom layer; (b) inserting a thin film circuit board having at least switch contact and a cable into the accommodation space between the flexible top layer and the flexible bottom layer to have the at least one switch contact be respectively aimed at the at least one conducting member; and (c) applying an adhesive to the periphery of the flexible top layer and the flexible bottom layer, and then applying a pressure to the flexible top layer and the flexible bottom layer to have the flexible top layer and the flexible bottom layer be bonded together and the thin film circuit board be sealed in between the flexible top layer and the flexible bottom layer and to have the cable extend out of one side of the flexible top layer and one side of the flexible bottom layer.

According to still another aspect of the watertight key switch assembly fabrication procedure according to the present invention, the watertight key switch assembly fabrication procedure further comprises a sub step (d) of bonding a reinforcing sheet member to a bottom surface of thin film circuit board after step (a) and before step (b).

According to still another aspect of the watertight key switch assembly fabrication procedure according to the present invention, the polymeric sheet members are selected from one of the materials of silicon rubber and rubber; the at least one conducting member each is a conducting carbon bead.

According to still another aspect of the watertight key switch assembly fabrication procedure according to the present invention, the step (a) of forming the flexible top layer and the flexible bottom layer is simultaneously to form a positioning structure between the flexible top layer and the flexible bottom layer, the positioning structure comprising a recess formed on one of the flexible top layer and the flexible bottom layer and adapted to accommodate the thin film circuit board, a plurality of mounting through holes formed on the thin film circuit board, a plurality of pinholes formed on one of the flexible top layer and the flexible bottom layer corresponding to the mounting through holes, and a plurality of pins formed on one of the flexible top layer and the flexible bottom layer without the pinholes and inserted through the mounting through holes and fitted into the pinholes.

According to still another aspect of the watertight key switch assembly fabrication procedure according to the present invention, the accommodation space comprises a recess formed on one of the flexible top and bottom layers for accommodating the thin film circuit board, and a cable slot formed on the other of the flexible top layer and the flexible bottom layer without the recess for the passing of the cable.

DETAILED DESCRIPTION OF THE INVENTION

Figure 1:
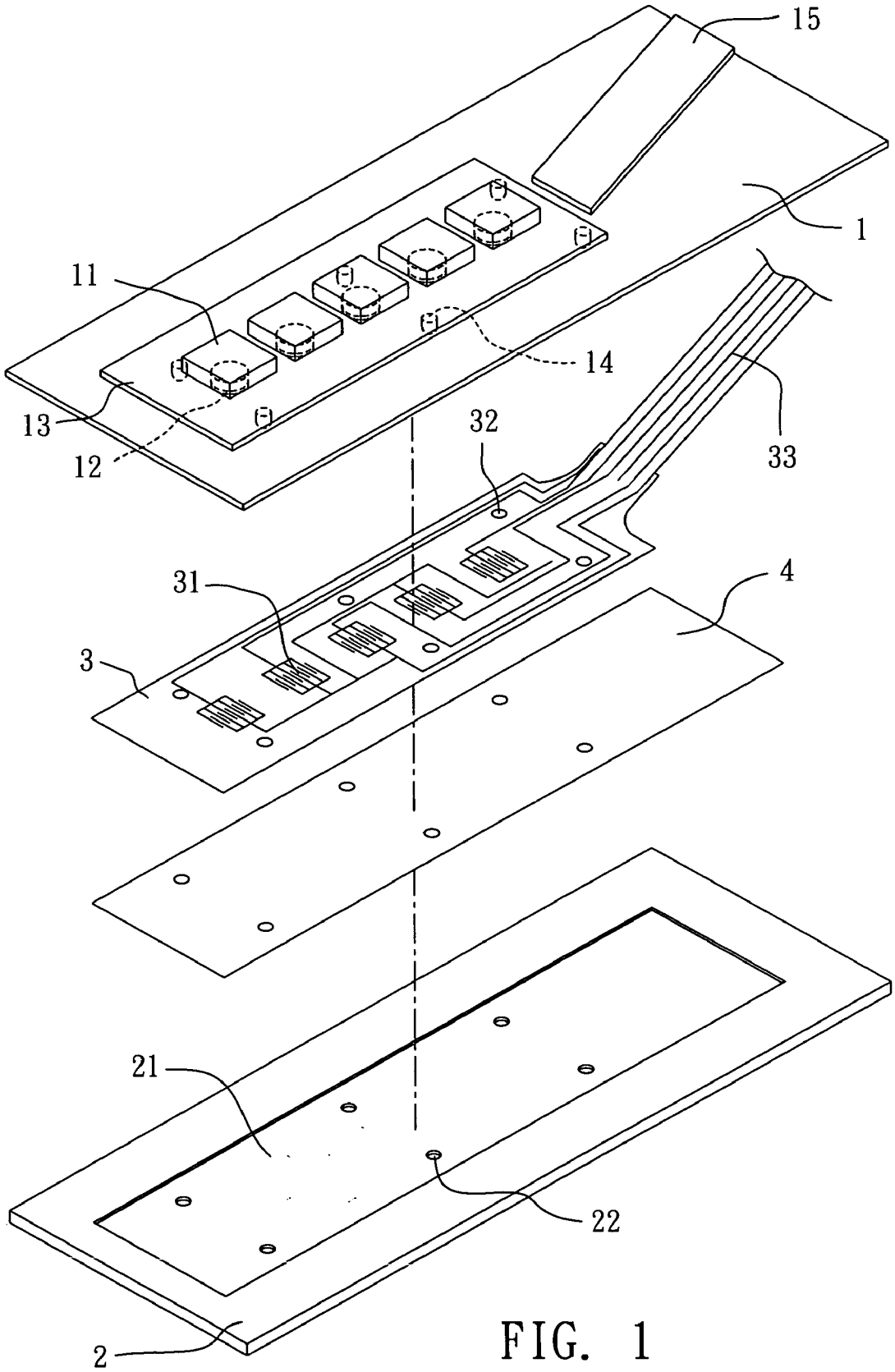
FIG. 1 is an exploded view of a watertight key switch assembly according to the present invention.
Figure 2:
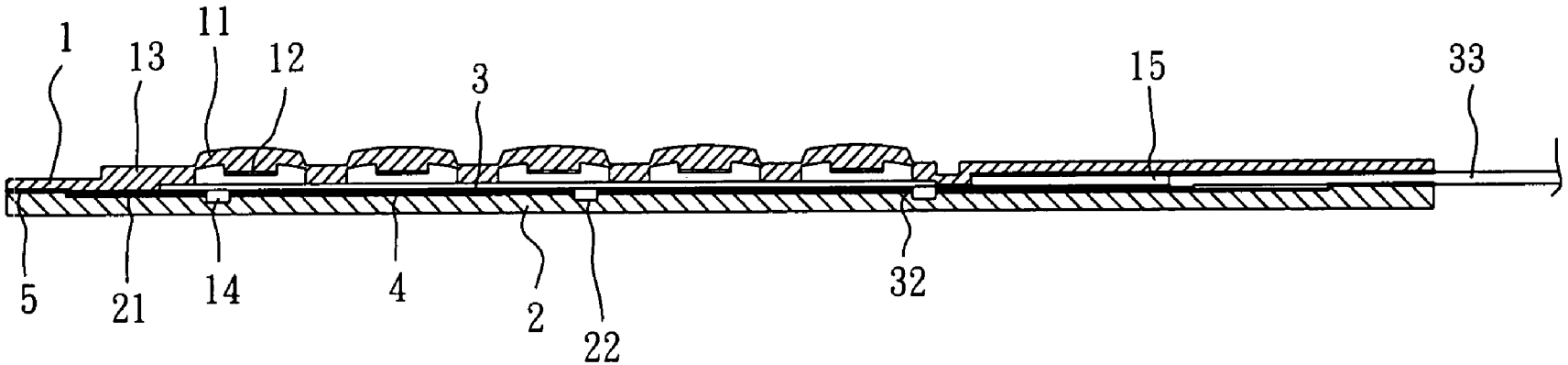
FIG. 2 is a sectional side of the present invention, showing the watertight key switch assembled.
Figure 3:
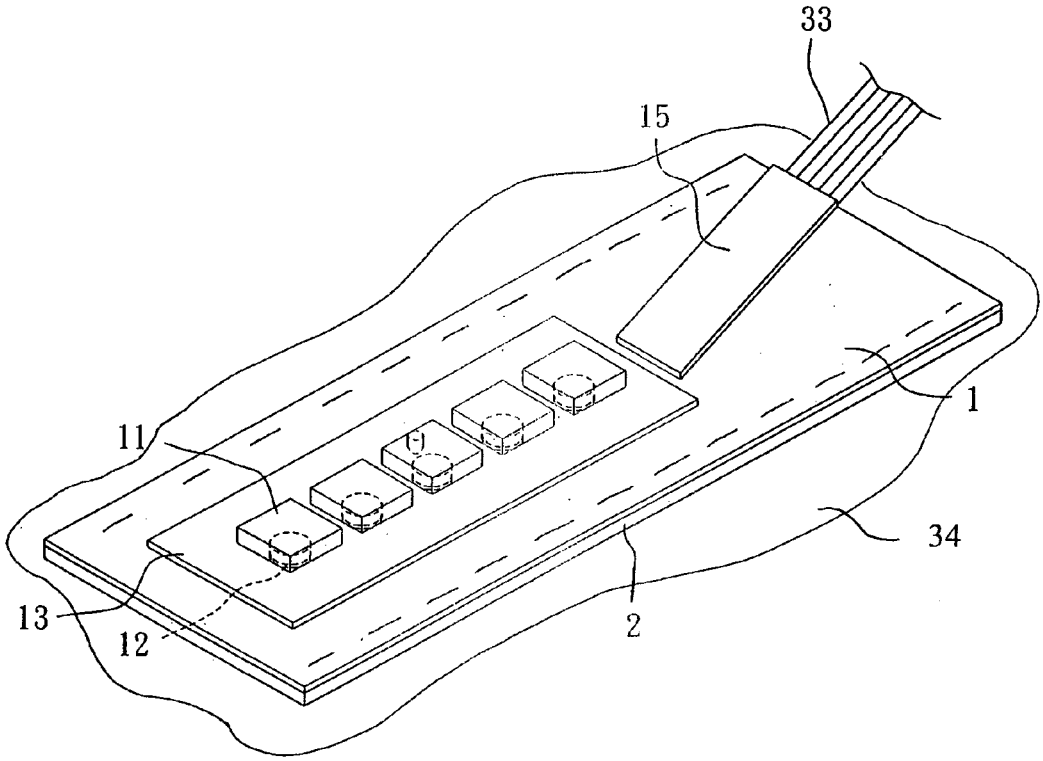
FIG. 3 is an elevational assembly view of the watertight key switch assembly according to the present invention.

Referring to FIGS. 1~3, a watertight key switch assembly in accordance with the present invention is shown comprised of a flexible e top layer 1, a flexible bottom layer 2, and a thin film circuit board 3.

The flexible top layer 1 is a sheet member made out of polymers, for example, silicon rubber or rubber, having a plurality of key caps 11, a conducting member, for example, conducting carbon bead 12 respectively fixedly mounted on the inside wall of each key cap 11, a plurality of bottom mounting pins 14 for fastening to the thin film circuit board 3, and a cable slot 15 on one side. Further, in order to increase the press stroke of the key caps 11, the key caps 11 are formed integral with an upwardly protruding platform 13 of the flexible top layer 1 at the top side.

The flexible bottom layer 2 is also made out of polymers, for example, silicon rubber or rubber, having a top recess 21 adapted to accommodate the thin film circuit board 3, and a plurality of pinholes 22 adapted to receive the bottom mounting pins 14 of the flexible top layer 1 respectively.

The thin film circuit board 3 is a flexible and bendable circuit board of the known art, having a plurality of switch contacts 31 printed thereon corresponding to the conducting members (conducting carbon beads) 12 in the key caps 11 of the flexible top layer 1, and a plurality of mounting through holes 32 for the passing of the bottom mounting pins 14 of the flexible top layer 1, and a flat cable 33 electrically connected to the switch contacts 31 and extended out of one side of the thin film circuit board 3 and inserted through the cable slot 15 of the flexible top layer 1. Further, in order to enhance the rigidity of the thin film circuit board 3, a reinforcing bottom sheet member 4, for example, PET (Polyethylene Terephthalate) film is bonded to the bottom surface of the thin film circuit board 3. The reinforcing bottom sheet member 4 has a plurality of through holes 41 corresponding to the mounting through holes 32 of the thin film circuit board 3 for the passing of the bottom mounting pins 14 of the flexible top layer 1.

During assembly of the present invention, the thin film circuit board 3 and the reinforcing bottom sheet member 4 are put in the top recess 21 of the flexible bottom layer 2 to have the mounting through holes 32, the through holes 41 and the pinholes 22 in alignment, and then the flexible top layer 1 is covered on the flexible bottom layer 2 to force the bottom mounting pins 14 through the mounting through holes 32 of the thin film circuit board 3 and the through holes 41 of the reinforcing bottom sheet member 4 into the pinholes 22 of the flexible bottom layer 2, thereby holding down the thin film circuit board 3 and the reinforcing bottom sheet member 4 in the top recess 21 of the flexible bottom layer 2, and then an adhesive 5, for example, liquefied silicon rubber or ultraviolet hardening agent is applied to the periphery of the stacked flexible top layer 1 and flexible bottom layer 2. When assembled, the cable 33 extends out of one side of the watertight key switch assembly for connection to the electronic product to be controlled.

When the user pressed one key cap 11 after installation of the watertight key switch assembly, the associating conducting member (conducting carbon bead) 12 is lowered to touch the associating switch contact 31 of the thin film circuit board 3, thereby causing the associating switch contact 31 to produce a corresponding electric control signal, for example, play control signal, volume control signal, or chapter adjustment control signal to the controlled electronic product to achieve the desired control. In one embodiment, the key switch assembly is stitched to fabric 34, as shown in FIG. 3.

Figure 4:
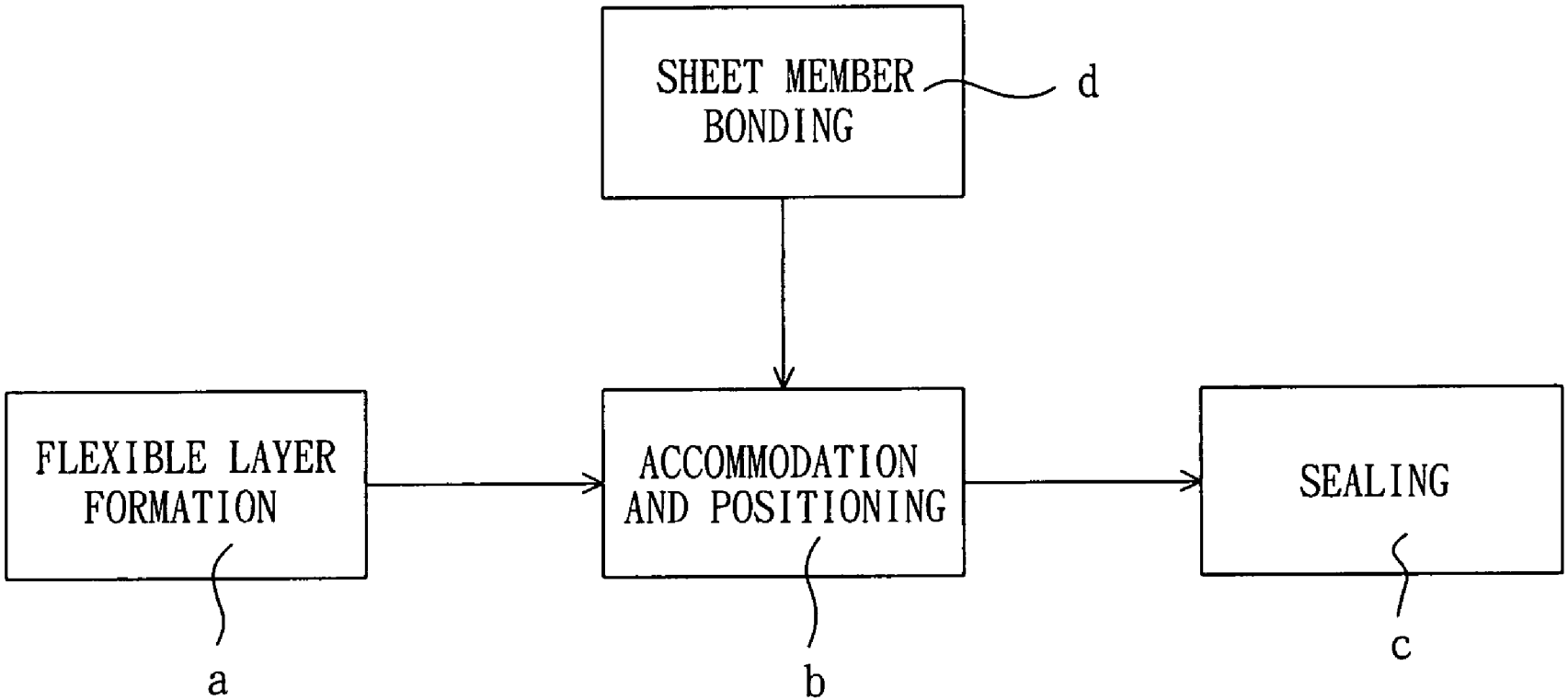
FIG. 4 is a manufacturing flow chart of the present invention.

FIG. 4 is a manufacturing flow chart of the present invention. As illustrated, the watertight key switch assembly fabrication procedure includes the steps of (a) flexible layer formation, (b) accommodation and positioning, (c) sealing.

During the step (a) of flexible layer formation, two polymeric sheet materials, for example, silicon rubber or rubber are put in the cavity of a mold, and conducting members (conducting carbon beads) 12 are placed on one polymeric material at locations for the designed key caps 11, and then the mold is closed and heated, and at the same time the mold is drawn into a vacuum state, and therefore the polymeric sheet materials are respectively molded into the desired flexible top layer 1 having the said cable slot 15 and bottom mounting rods 14 and the desired flexible bottom layer 2 having the said top recess 21 and the said pinholes 22. After molding, an accommodation space is defined between the flexible top layer 1 and the flexible bottom layer 2.

During the step (b) of accommodation and positioning, the prepared thin film circuit board 3 having the said switch contacts 31 and the said mounting through holes 32 and the said cable 33 is inserted into the accommodation space between the flexible top layer 1 and the flexible bottom layer 2 and set into position to have the printed switch contacts 31 of the thin film circuit board 3 be respectively aimed at the conducting members (conducting carbon beads) 12 and the cable 33 be extended out of the cable slot 15 of the flexible top layer 1 and the mounting through holes 32 be in alignment between the bottom mounting rods 14 of the flexible top layer 1 and the pinholes 22 of the flexible bottom layer 2.

Further, in order to enhance the rigidity of the thin film circuit board 3, a sub-step, i.e., step (d) of sheet member bonding may be employed after the step (a) and before the step (b). The step (d) of sheet member bonding is to bond a reinforcing bottom sheet member 4, for example, PET (Polyethylene Terephthalate) film to the bottom surface of the thin film circuit board 3. The reinforcing bottom sheet member 4 has the aforesaid through holes 41 respectively aimed at the mounting through holes 32 of the thin film circuit board 3.

During the step (c) of sealing, an adhesive, for example, liquefied silicon rubber or ultraviolet hardening agent is applied to the periphery of the flexible top layer 1 and the flexible bottom layer 2, and then a pressure is employed to the flexible top layer 1 and the flexible bottom layer 2 to have the flexible top layer 1 and the flexible bottom layer 2 be bonded together. When assembled, the cable 33 extends out of one side of the watertight key switch assembly for connection to the electronic product to be controlled.

Further, during the aforesaid fabrication procedure, the flexible top layer 1 and the flexible bottom layer 2 may be molded from different materials, for example, TPU (Polyurethane Thermoplastic Elastomer) film for the flexible top layer 1 and PC (Polycarbonate) film for the flexible bottom layer 2; mylar for the flexible top layer 1 and PC (Polycarbonate) film for the flexible bottom layer 2; PET (Polyethylene Terephthalate) film for the flexible top layer 1 and PC (Polycarbonate) film for the flexible bottom layer 2. Further, the flexible top layer 1 and the flexible bottom layer 2 preferably have a film thickness about 2 mm~3 mm that provides the desired flexibility and watertight characteristic.

A watertight key switch assembly made according to the present invention has the following features:

1. By means of the material properties of the flexible top and bottom layers and the thin film circuit board, the watertight key switch assembly is flexible and bendable. Further, the thin film circuit board is embedded in between the flexible top and bottom layers and well sealed by the flexible top and bottom layers, achieving the desired watertight effect.

2. The switching structure of the conducting members (conducting carbon beads) 12 and the conducting the printed switch contacts 31 is free from the influence of the environment, and therefore the watertight key switch assembly is superior in weather-resisting property.

3. Because of watertight, weather-resisting, flexible and bendable features, the watertight key switch assembly is practical for use in 3C electronic products and sports electronics.

4. Further, the watertight key switch assembly can be directly stitched to a backpack, the sleeve or front panel of a garment, the pocket side of a pair of paints, etc. and machine washable with the backpack, garment, paints, etc.

A prototype of watertight key switch assembly has been constructed with the features of FIGS. 1~4. The watertight key switch assembly functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A watertight key switch assembly comprising:

a flexible top layer made out of a polymeric material, said flexible top layer having at least one key cap and a conducting member respectively fixedly mounted on an inside wall of each of said at least one key cap;

a flexible bottom layer made out of a polymeric material fastened to said flexible top layer and defining with said flexible top layer an accommodation space;

a thin film circuit board set in the accommodation space between said flexible top layer and said flexible bottom layer and sealed to said flexible top layer and said flexible bottom layer with an adhesive, said thin film circuit board having at least one printed switch contact means corresponding to the conducting member in each of said at least one key cap for the contact of the associating conducting member to output a corresponding electric signal, and a cable electrically connected to said at least one printed switch contact means and extended out of one side of said flexible top layer and the corresponding side of said flexible bottom layer for connection to an external electronic device, wherein the watertight key switch assembly is configured to be stitched to fabric and to remain functional after being subjected to washing, drying, and folding.

2. The watertight key switch assembly as claimed in claim 1, wherein said at least one conducting member each is a conducting carbon bead.

3. The watertight key switch assembly as claimed in claim 1, wherein said flexible top layer has an upwardly protruding platform; said at least one key cap is formed integral with said upwardly protruding platform.

4. The watertight key switch assembly as claimed in claim 1, further comprising a positioning structure between said flexible top layer and said flexible bottom layer, said positioning structure comprising a recess formed on one of said flexible top layer and said flexible bottom layer and adapted to accommodate said thin film circuit board, a plurality of mounting through holes formed on said thin film circuit board, a plurality of pinholes formed on one of said flexible top layer and said flexible bottom layer corresponding to said mounting through holes, and a plurality of pins formed on one of said flexible top layer and said flexible bottom layer without said pinholes and respectively inserted through said mounting through holes and fitted into said pinholes.

5. The watertight key switch assembly as claimed in claim 1, wherein said accommodation space comprises a recess formed on one of said flexible top layer and said flexible bottom layer for accommodating said thin film circuit board, and a cable slot formed on the other of said flexible top layer and said flexible bottom layer without said recess for the passing of said cable.

6. The watertight key switch assembly as claimed in claim 1, wherein said thin film circuit board has a bottom surface bonded with a reinforcing sheet member.

7. The watertight key switch assembly as claimed in claim 1, wherein said flexible top layer and said flexible bottom layer are respectively prepared from one of the combinations of TPU (Polyurethane Thermoplastic Elastomer) film and PC (Polycarbonate) film; mylar and PC (Polycarbonate) film; PET (Polyethylene Terephthalate) film and PC (Polycarbonate) film.

8. A watertight key switch assembly fabrication procedure comprising the steps of:

(a) putting two polymeric sheet materials in the cavity of a mold, and then placing at least one conducting member on one polymeric sheet material at each selected location key cap, and then closing said mold and heating said mold and drawing air out of said mold into a vacuum state to have said polymeric sheet materials be respectively molded into a flexible top layer and a flexible bottom layer where an accommodation space is defined between said flexible top layer and said flexible bottom layer and said at least one conducting member is fixedly fastened to one of said flexible top layer and said flexible bottom layer;

(b) inserting a thin film circuit board having at least switch contact and a cable into said accommodation space between said flexible top layer and said flexible bottom layer to have said at least one switch contact be respectively aimed at said at least one conducting member; and (c) applying an adhesive to the periphery of said flexible top layer and said flexible bottom layer, and then applying a pressure to said flexible top layer and said flexible bottom layer to have said flexible top layer and said flexible bottom layer be bonded together and said thin film circuit board be sealed in between said flexible top layer and said flexible bottom layer and to have said cable extend out of one side of said flexible top layer and one side of said flexible bottom layer, wherein a watertight key switch assembly formed by the above fabrication process is configured to be stitched to fabric and to remain functional after being subjected to washing, drying, and folding.

9. The watertight key switch assembly fabrication procedure as claimed in claim 8, further comprising a sub step (d) of bonding a reinforcing sheet member to a bottom surface of thin film circuit board after step (a) and before step (b).

10. The watertight key switch assembly fabrication procedure as claimed in claim 8, wherein said polymeric sheet members are selected from one of the materials of silicon rubber and rubber; said at least one conducting member each is a conducting carbon bead.

11. The watertight key switch assembly fabrication procedure as claimed in claim 8, wherein said step (a) of forming said flexible top layer and said flexible bottom layer is simultaneously to form a positioning structure between said flexible top layer and said flexible bottom layer, said positioning structure comprising a recess formed on one of said flexible top layer and said flexible bottom layer and adapted to accommodate said thin film circuit board, a plurality of mounting through holes formed on said thin film circuit board, a plurality of pinholes formed on one of said flexible top layer and said flexible bottom layer corresponding to said mounting through holes, and a plurality of pins formed on one of said flexible top layer and said flexible bottom layer without said pinholes and inserted through said mounting through holes and fitted into said pinholes.

12. The watertight key switch assembly fabrication procedure as claimed in claim 8, wherein said accommodation space comprises a recess formed on one of said flexible top layer and said flexible bottom layer for accommodating said thin film circuit board, and a cable slot formed on the other of said flexible top layer and said flexible bottom layer without said recess for the passing of said cable.

13. The watertight key switch assembly fabrication procedure as claimed in claim 8, wherein said flexible top layer and said flexible bottom layer are respectively prepared from one of the combinations of TPU (Polyurethane Thermoplastic Elastomer) film and PC (Polycarbonate) film; mylar and PC (Polycarbonate) film; PET (Polyethylene Terephthalate) film and PC (Polycarbonate) film.

* * * * *